US007782335B2

(12) United States Patent
Baek

(10) Patent No.: US 7,782,335 B2
(45) Date of Patent: Aug. 24, 2010

(54) APPARATUS FOR DRIVING LIQUID CRYSTAL DISPLAY DEVICE AND DRIVING METHOD USING THE SAME

(75) Inventor: Heume Il Baek, Kyonggi-do (KR)

(73) Assignee: LG Display Co., Ltd., Seoul (KR)

( * ) Notice: Subject to any disclaimer, the term of this patent is extended or adjusted under 35 U.S.C. 154(b) by 1286 days.

(21) Appl. No.: 11/300,345

(22) Filed: Dec. 15, 2005

(65) Prior Publication Data

US 2006/0256053 A1 Nov. 16, 2006

(30) Foreign Application Priority Data

May 12, 2005 (KR) ..... 10-2005-0039728

(51) Int. Cl.
*G09G 5/00* (2006.01)

(52) U.S. Cl. ..... 345/586; 345/72

(58) Field of Classification Search ..... 345/72, 345/83, 88, 589–605
See application file for complete search history.

(56) References Cited

U.S. PATENT DOCUMENTS 5,436,733 A * 7/1995 Terada et al. ..... 358/448
5,583,578 A * 12/1996 Tateishi ..... 348/615
7,151,517 B2 * 12/2006 Lee ..... 345/88
2004/0046725 A1 3/2004 Lee
2004/0222999 A1 * 11/2004 Choi et al. ..... 345/589
2004/0223005 A1 11/2004 Lee

FOREIGN PATENT DOCUMENTS

JP 2004-022864 10/2004
JP 2006-133711 5/2006
JP 2008-026339 2/2008

* cited by examiner

*Primary Examiner*—Sumati Lefkowitz
*Assistant Examiner*—Ke Xiao
(74) *Attorney, Agent, or Firm*—Morgan, Lewis & Bockius LLP

(57) ABSTRACT

An apparatus for driving a liquid crystal display (LCD) device includes a liquid crystal panel including 4-color sub-pixels, a data driver to provide video data signals to each sub-pixel, a gate driver to provide a scan pulse to each sub-pixel, a data conversion part to generate a gain value by analyzing a ratio of an achromatic color signal to a chromatic color signal of 3-color source data inputted from an external source and convert the 3-color source data into 4-color data using the generated gain value, and a timing controller to provide the 4-color data received from the data conversion part to the data driver and control the gate driver and the data driver.

36 Claims, 8 Drawing Sheets

APPARATUS FOR DRIVING LIQUID CRYSTAL DISPLAY DEVICE AND DRIVING METHOD USING THE SAME

This application claims the benefit of the Korean Patent Application No. P2005-0039728 filed on May 12, 2005, which is hereby incorporated by reference.

BACKGROUND OF THE INVENTION

1. Field of the Invention

The present invention relates to a liquid crystal display (LCD) device, and more particularly to an apparatus for driving an LCD device and a driving method using the same for naturally displaying various images on an RGBW type display.

2. Discussion of the Related Art

Recently, various flat-panel displays have been developed to overcome disadvantages of cathode ray tube (CRT) displays such as heavy weight and high depth. Flat-panel displays include liquid crystal displays (LCDs), field emission displays (FEDs), plasma display panels (PDPs), and light emitting displays (LEDs).

Among the flat-panel displays, the LCD device includes a TFT (thin film transistor) substrate, color filter substrate, and a liquid crystal layer. Generally, a plurality of liquid crystal cells, which are arranged in an area defined by a plurality of data lines and a plurality of gate lines, are formed on the TFT substrate. Each of liquid crystal cells define a liquid crystal pixel, and a TFT, which acts as a switching device, is formed in each liquid crystal pixel. Color filters are formed on the color filter substrate and the liquid crystal layer is formed between the TFT substrate and the color filter substrate.

The LCD device generates an electric field in each pixel according to data signals applied to the data lines and reproduces various images by controlling transmissivity of the liquid crystal layer. Because degradation occurs when an electric field is applied to the liquid crystal in a particular direction for a long period of time, the polarity of a data signal is reversed for each frame, column, or dot to prevent such damage.

The LCD device makes an image by mixing red, green, and blue lights provided by 3-color pixels of red (R), green (G), and blue (B). However, in general, light efficiency of a typical LCD device for displaying one sub-pixel using 3-color dots of red (R), green (G), and blue (B) is relatively low. More specifically, since a color filter arranged in each sub-pixel of red (R), green (G), and blue (B) allows about ⅓ of incident light to penetrate the filter, light efficiency is significantly reduced.

In order to maintain the color realization ratio and to improve the light efficiency in the LCD device, Korean Patent publication No. P2002-13830 ("LCD Device") and Korean Patent publication No. P2004-83786 ("Apparatus for Driving of Display Device and Method for Driving Thereof") discloses an RGBW type LCD device, which includes a white color filter W in additional to the red, green, and blue color filters. The above-described RGBW type LCD device converts a 3-color image signal into a 4-color image signal, thereby increasing brightness of a color image.

FIG. 1 illustrates a view of a color area to be embodied in an RGBW type display device according to the related art. FIG. 1 shows Gamut plane coordinates with red (R) and green (G) axes displayed in three-dimensional orthogonal coordinates with red (R), green (G) and blue (B) axes. A square area indicated by solid lines represents colors to be displayed by a 3-color image signal, and a hexahedron area indicated by thick solid lines represents colors to be displayed by a 4-color image signal. That is, the RGBW type liquid crystal display device extends a color area in a diagonal direction as indicated by dotted lines adding white (W) to a 3-color of red (R), green (G), and blue (B). As a result, in a process for converting a 3-color image signal into a 4-color image signal, each coordinate in the square is extended into coordinates in the hexahedron.

In the RGBW type LCD device, an apparatus for converting a 3-color image signal into a 4-color image signal has various gain curve characteristics G1, G2, G3, and G4. Even though the gain curves G1, G2, G3, and G4 vary, brightness amplification factors in the gain curves G1, G2, G3, and G4 with respect to white (W) are the same. However, each 3-color image signal (A) with respect red (R), green (G), and blue (B) colors has a different amplification factor, such as A', A", and A'". Accordingly, the brightness amplification factors of white (W) and any 3-color image signal (A) in any one of the gain curves are different from each other.

For example, when an image in which pure color with a gain value of "1" and tone color with a gain value of "2" are mixed, the brightness amplification factors are considerably different. Thus, since the brightness amplification factors according to an inputted 3-color image signal in the RGBW type LCD device are different from each other, an image perceived from the RGBW type LCD device is different from that of an RGB type liquid crystal display device. In addition, the RGBW type LCD device requires an operation circuit to employ the gain curve, but it is difficult to design the operation circuit to perform complicated operations.

SUMMARY OF THE INVENTION

Accordingly, the present invention is directed to an apparatus for driving a LCD device and a driving method using the same that substantially obviate one or more problems due to limitations and disadvantages of the related art.

An object of the present invention is to provide an apparatus for driving an LCD device and a driving method using the same for naturally displaying various images on an RGBW type display device.

Another object of the present invention is to provide an apparatus for driving an LCD device and a driving method using the same for converting a 3-color image signal into a 4-color image signal using a simplified operation.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, an apparatus for driving a liquid crystal display (LCD) device includes a liquid crystal panel including 4-color sub-pixels, a data driver to provide video data signals to each sub-pixel, a gate driver to provide a scan pulse to each sub-pixel, a data conversion part to generate a gain value by analyzing a ratio of an achromatic color signal or a chromatic color signal of 3-color source data inputted from an external source in a unit frame and convert the 3-color source data into 4-color data using the generated gain value, and a timing controller to provide the 4-color data received from the data conversion part to the data driver and control the gate driver and the data driver.

In another aspect, a method for controlling a liquid crystal display (LCD) device which includes a liquid crystal panel including 4-color sub-pixels, a data driver for providing video data signals to each sub-pixel, and a gate driver for providing a scan pulse to the sub-pixels includes generating a gain value by analyzing a ratio of an achromatic color signal or a chromatic color signal of 3-color source data inputted from an external source in a unit frame, converting the 3-color source data into 4-color video data using the generated gain value, generating the scan pulse, and applying the 4-color video data to each sub-pixel in synchronization with the scan pulse.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention. In the drawings.

It will be apparent to those skilled in the art that various modifications and variations can be made in the apparatus for driving LCD device of the present invention and driving method using the same without departing from the spirit or scope of the invention. Thus, it is intended that the present invention cover the modifications and variations of this invention provided they come within the scope of the appended claims and their equivalents.

DETAILED DESCRIPTION OF THE PREFERRED EMBODIMENTS

Reference will now be made in detail to the preferred embodiments of the present invention, examples of which are illustrated in the accompanying drawings. Wherever possible, the same reference numbers will be used throughout the drawings to refer to the same or like parts.

Figure 1:
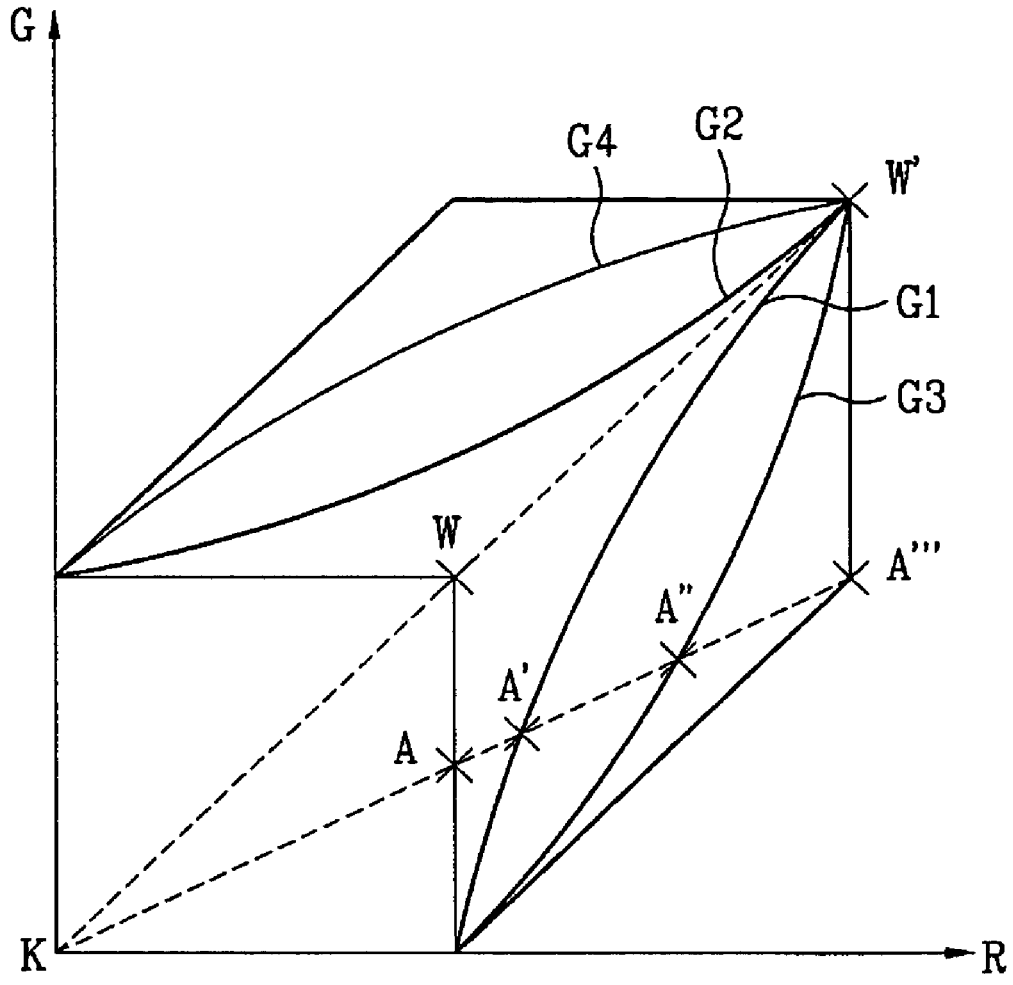
FIG. 1 Related Art
FIG. 1 is a graph illustrating a color area to be embodied in an RGBW type display device according to the related art.
Figure 2:
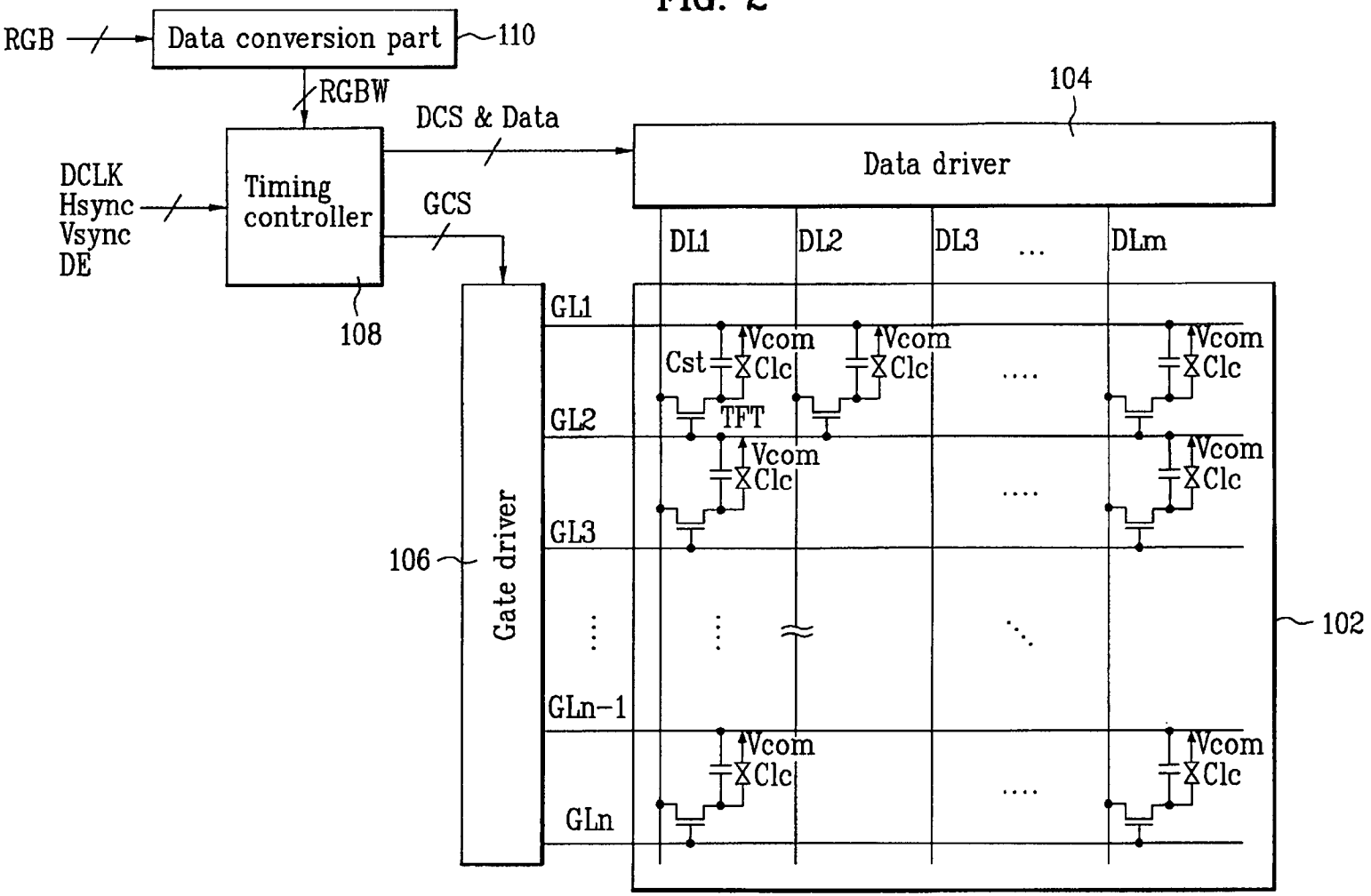
FIG. 2 is a block diagram showing a configuration of an apparatus for driving a liquid crystal display device according to an exemplary embodiment of the present invention.

FIG. 2 shows a block diagram illustrating the configuration of an apparatus for driving a liquid crystal display device according to an exemplary embodiment of the present invention. The exemplary LCD driving apparatus of the present invention includes a liquid crystal panel 102 having liquid crystal cells in matrix form defined by n gate lines (GL1 to GLn) and m data lines (DL1 to DLm), a data driver 104 for providing video data signals to the data lines (DL1 to DLm), a gate driver 106 for providing a scan pulse to the gate lines (GL1 to GLn), and a data conversion part 110 for converting a 3-color source data (RGB) into 4-color data (RGBW). A timing controller 108 arranges the converted 4-color data (RGBW) from the data conversion part 110 and provides the arranged 4-color data (RGBW) to the data driver 104. The timing controller 108 generates data control signals (DCS) to control the data driver 104 and generates gate control signals (GCS) to control the gate driver 106.

The liquid crystal panel 102 includes thin film transistors (TFT) formed in the area defined by the n gate lines (GL1 to GLn) and the m data lines (DL1 to DLm) and connected to the corresponding liquid crystal cells. Each TFT responds to the scan pulse inputted through the n-gate lines (GL1 to GLn) and provides the video data signal inputted through the m-data lines (DL1 to DLm) to the corresponding liquid crystal cell. Since the liquid crystal cell is composed of a common electrode and a sub-pixel electrode arranged parallel to each other, the liquid crystal cell is represented as a liquid crystal capacitor (Clc). The liquid crystal cell also includes a storage capacitor (Cst) connected to the previous gate line so as to maintain a present data signal on the liquid crystal capacitor (Clc) until the next data signal is applied.

The liquid crystal panel 102 is arranged such that red (R), green (G), blue (B), and white (W) sub-pixels are formed repeatedly along each column of the liquid crystal cell matrix. Each red (R), green (G), and blue (B) sub-pixel employs a corresponding color filter while the white (W) sub-pixel does not employ a color filter. In addition, the red (R), green (G), blue (B), and white (W) sub-pixels may form a stripe structure having either a same width ratio or a different size ratio. For example, the red (R), green (G), blue (B), and white (W) sub-pixels may be arranged in a quad—i.e., a 2×2 matrix.

The data conversion part 110 analyzes, in a unit frame, a ratio of an achromatic color signal or a chromatic color signal of the 3-color source data (RGB) inputted from an external source in a unit frame and generates a gain value (G). The data conversion part 110 amplifies the 3-color source data (RGB) according to the generated gain value (G) and converts the 3-color source data (RGB) to 4-color data (RGBW) using white (W) data abstracted from a common component of the amplified 3-color source data (RGB). The converted 4-color data (RGBW) is then provided to the timing controller 108.

The timing controller 108 arranges the 4-color data (RGBW) provided from the data conversion part 110 so as to drive of the liquid crystal 102. In addition, the timing controller 108 generates data control signals (DCS) and gate control signals (GCS) using a main clock signal (DCLK), a data enable signal (DE), and horizontal and vertical synchronization signals (Hsync, Vsync) inputted from an external source to control the drive timing of each data driver 104 and gate driver 106.

The gate driver 106 includes a shift register to sequentially generate scan pulses, i.e., gate high pulses, in response to a gate start pulse GSP and a gate shift clock GSC among the gate control signals GCS outputted from the timing controller 108. The TFT is turned on in response to the scan pulses provided by the gate driver 106.

The data driver 104 converts the 4-color data (RGBW) according to the data control signals (DCS) provided by the timing controller 108 into an analog video data and provides the video data signal to the data lines (DL1 to DLm). The video data signal corresponds to one horizontal line with respect to each 1 horizontal period corresponding to the scan pulse provided to the gate lines (GL1 to GLn). In particular, the data driver 104 selects a gamma voltage with a predetermined level according to a gray-scale value of the 4-color data (RGBW) and applies the selected gamma voltage to data lines (DL1 to DLm).

Figure 3:
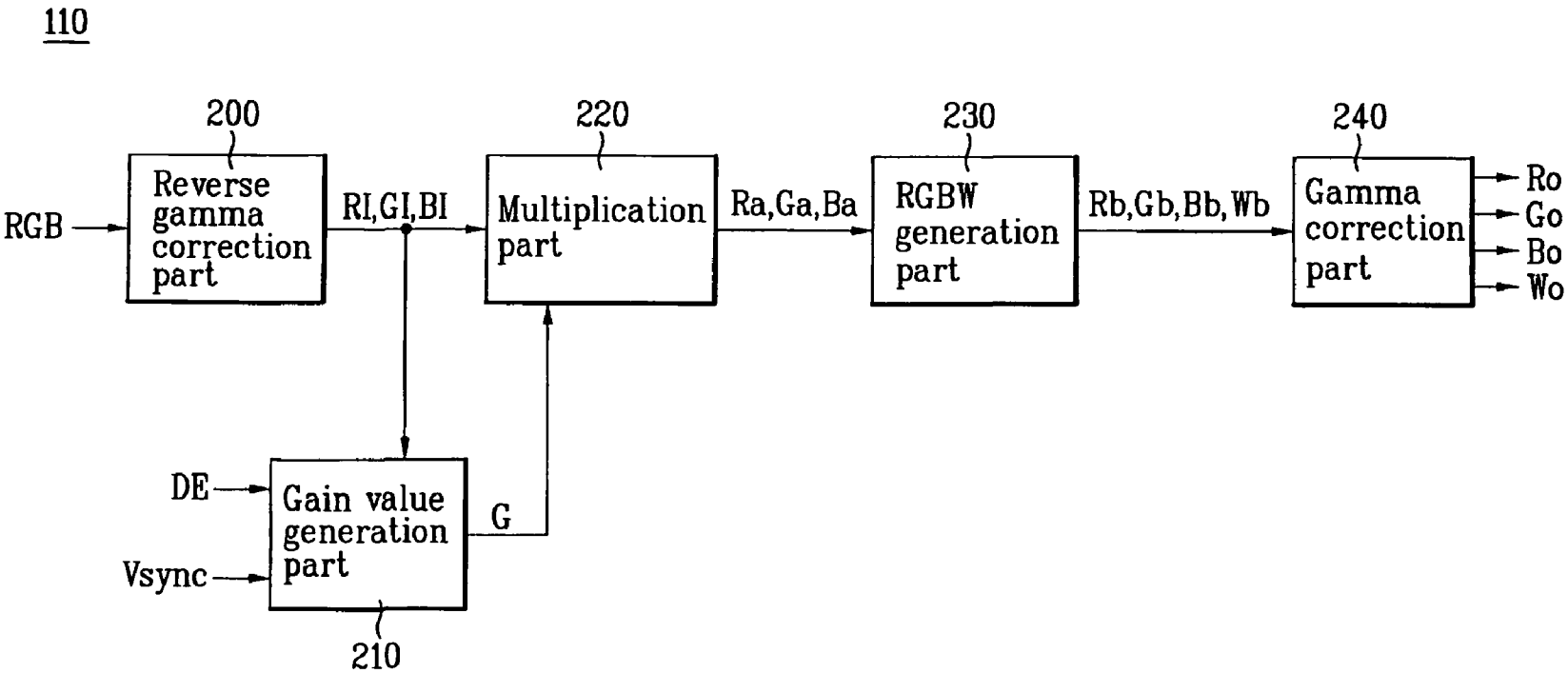
FIG. 3 is a block diagram illustrating a configuration of a first exemplary embodiment of a data conversion part of FIG. 2 according to the present invention.

FIG. 3 shows a block diagram illustrating a configuration of a first exemplary embodiment of the data conversion part 110 of FIG. 2. As shown in FIG. 3, the first exemplary embodiment of the data conversion part 110 for converting a 3-color data (RGB) into a 4-color data (RGBW) includes a reverse gamma correction part 200, a gain value generation part 210, a multiplication part 220, an RGBW generation part 230, and a gamma correction part 240.

Because the 3-color source data (RGB) inputted from an external source is a gamma-corrected signal adjusted for an output characteristic of a cathode ray tube, the reverse gamma correction part 200 converts the 3-color source data (RGB) into a linearized 3-color input data (RI, GI, BI) using equation 1 as follows:

$$RI=R^{\lambda}$$

$$GI=G^{\lambda}$$

$$BI=B^{\lambda} \qquad \text{(Equation 1)}$$

Figure 4:
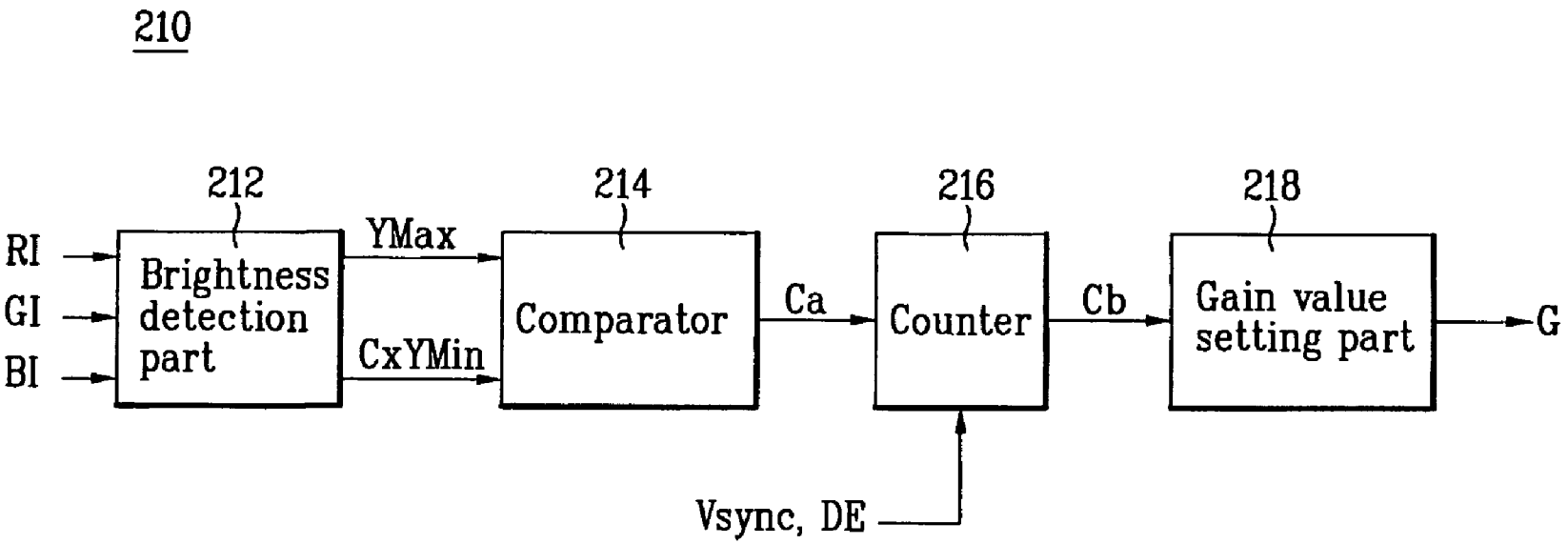
FIG. 4 is a block diagram illustrating a configuration of an exemplary gain value generation part of FIG. 3.

The gain value generation part 210 calculates a percentage of an achromatic color signal in a unit frame using a maximum brightness value (YMax) and a minimum brightness value (YMin) of the 3-color input data (RI, GI, BI) outputted from the reverse gamma correction part 200 and then generates a gain value (G). FIG. 4 shows a block diagram illustrating a configuration of an exemplary embodiment of a gain value generation part of FIG. 3.

As shown in FIG. 4, the gain value generation 210 includes a brightness detection part 212, a comparator 214, a counter 216, and a gain value setting part 218. The brightness detection part 212 detects a maximum brightness value (YMax) and a minimum brightness value (YMin) of the 3-color input data (RI, GI, BI) provided from the reverse gamma correction part 200. Based on the detected minimum brightness value (YMin), a calculated maximum brightness value is generated according to the following equation:

$$Y\max=C\times Y\min \qquad \text{(Equation 2)},$$

where, "C" represents a constant that is a positive real number and is set on the basis of gain values determined with respect to various images. Thereafter, brightness detection part 212 provides the detected maximum brightness value (YMax) and the calculated maximum brightness value, i.e., a C-multiplied minimum brightness value (C×YMin), to the comparator 214.

The comparator 214 compares the detected maximum brightness value (YMax) and the C-multiplied minimum brightness value (C×YMin) provided from the brightness detection part 212 and outputs a comparison result signal (Ca). The comparator 214 outputs the comparison result signal (Ca) with a high logical value "1" when the detected maximum brightness value (YMax) exceeds the C-multiplied minimum brightness value (C×Ymin); otherwise, the comparator 214 outputs the comparison result signal (Ca) with a low logical value "0" according to the following relationship:

$$Y\max\leqq C\times Y\min \text{--->achromatic color signal}$$

$$Y\max>C\times Y\min \text{--->chromatic color signal} \qquad \text{(Equation 3)}.$$

The counter 216 counts the comparison result signal (Ca) provided by the comparator 214 during a unit frame according to a data enable signal (DE) and a vertical synchronization signal (Vsync) provided from an external source and generates a count signal (Cb). The counter 216 is then reset in a unit frame according to the vertical synchronization signal (Vsync).

The gain value setting part 218 sets the gain value (G) using the count signal (Cb) provided from the counter 216 and provides the gain value (G) to the multiplication part 220 in accordance with:

$$G=1+\alpha\left(\frac{Cb}{Tpixel}\right), \qquad \text{(Equation 4)}$$

where, α represents a minimum value of αR, αG, and αB representing a relative amount of the white (W) sub-pixel contribution to the brightness of the red (R), green (G), and blue (B) pixels in an RGBW display device, and Tpixel represents the total number of pixels of the liquid crystal panel 102. Thus, the gain value (G) has a range of 1~1+α.

Figure 5:
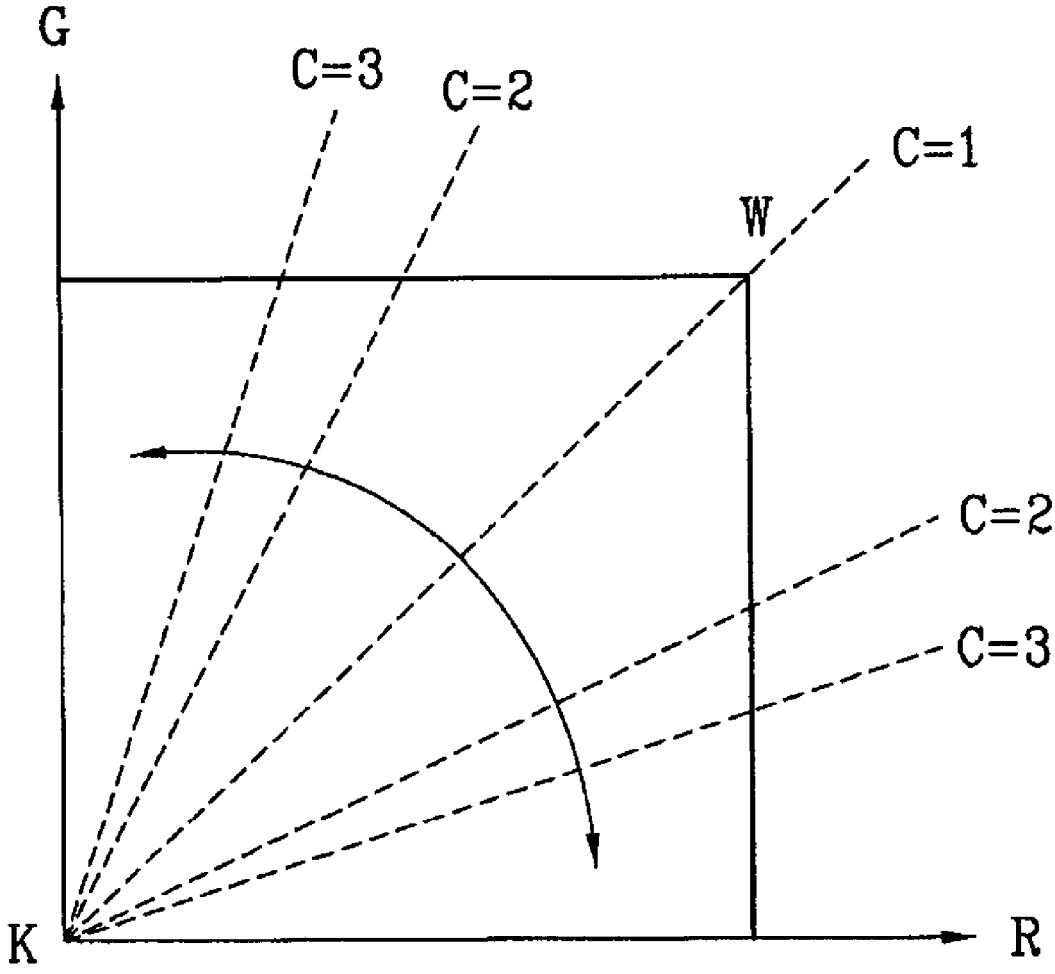
FIG. 5 is a graph illustrating a determination criterion with respect to an achromatic color signal and a chromatic color signal in an RGB coordinate system.

The gain value generation part 210 determines whether the 3-color input data (RI, GI, BI) is an achromatic color signal or a chromatic color signal using equations 2 and 3 above. FIG. 5 shows a graphical representation of a criterion for determining whether the 3-color input data (RI, GI, BI) is an achromatic color signal or a chromatic color signal according to equations 2 and 3 in an RGB coordinate system.

As shown in FIG. 5, a black signal and a white signal are present on a line where the maximum brightness value (Ymax) and the minimum brightness value (YMin) are the same (C=1). Therefore, in a case of pure red (R) or pure green (G), the minimum brightness value (YMin) is 0. When the constant C is increased according to equation 2, it is close to a chromatic color. When the constant C=1, it is completely an achromatic color. Accordingly, if signals in a unit frame are analyzed by setting a plurality of determination criteria, it is possible to analyze signals of the corresponding frame more accurately. The present invention sets the constant C as one determination criterion.

As explained above, the gain value generation part 210 sets the gain value (G) using equation 4. In a an XGA (extended Graphics Array) resolution LCD device (1024*768), a total number of sub-pixels in one frame is 786,432. Thus, when counting any one of the achromatic color signal and the chromatic color signal using the counter 216, the remainder is acquired by subtracting the result from the total number of sub-pixels. This allows counting of effective data in one frame using the vertical synchronization signal (Vsync) and the data enable signal (DE).

In general, the gain value (G) corresponding to the frame must be produced using a frame memory. However, frame memories increase the cost of the apparatus. Because there is little difference between previous and next images of one frame in a typical moving picture, the present invention employs the gain value (G) produced from the previous frame. As a result, the gain value generation part 210 according to the present invention equally obtains the gain value (G) for brightness amplification in a unit frame by analyzing the input data (RI, GI, BI) in a unit frame using equations 2 and 4. Accordingly, the multiplication part 220 generates 3-color amplification data (Ra, Ga, Ba) by multiplying the 3-color input data (RI, GI, BI) from the reverse gamma correction part 200 with the gain value (G) from the gain value generation part 210 and provides the 3-color amplification data (Ra, Ga, Ba) to the RGBW generation part 230. The 3-color amplification data (Ra, Ga, Ba) are generated according to the following equation:

$$Ra=G\times RI$$

$$Ga=G\times GI$$

$$Ba=G\times BI \quad \text{(Equation 5).}$$

Figure 6:
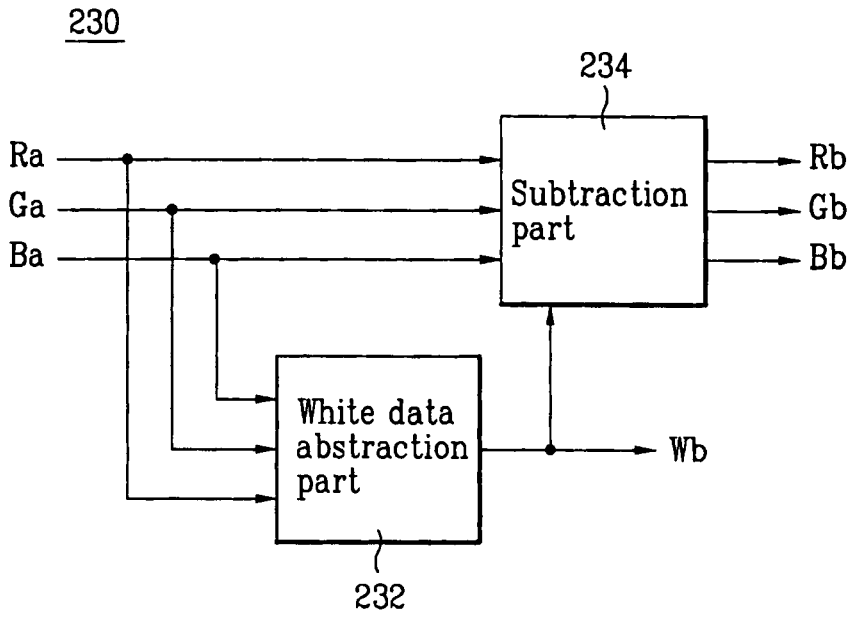
FIG. 6 is a block diagram illustrating a configuration of an exemplary RGBW generation part of FIG. 3.

As previously explained, the RGBW generation part 230 abstracts white data (Wb) from a common component of the 3-color amplification data (Ra, Ga, Ba) from the multiplication part 220, generates the 4-color data (RGBW) using the abstracted white data (Wb), and provides the 4-color data (RGBW) to the gamma correction part 240 (FIG. 3). FIG. 6 shows a block diagram illustrating a configuration of an exemplary RGBW generation part of FIG. 3.

As shown in FIG. 6, the RGBW generation part 230 includes a white data abstraction part 232 and a subtraction part 234. The white data abstraction part 232 abstracts the white data (Wb) from the common component of the 3-color amplification data (Ra, Ga, Ba) from the multiplication part 220, and provides the white data (Wb) to the subtraction part 234. The white data (Wb) is abstracted in accordance with the following equation:

$$Wb=\mathrm{Min}(Da,1) \quad \text{(Equation 6),}$$

where, Da is Ra, Ga, or Ba.

The white data abstraction part 232 abstracts the common component from a minimum value of 3-color amplification data (Ra, Ga, Ba) of red (R), green (G), and blue (B), sets the common component to the white data (Wb), and outputs the white data (Wb). For purposes of example, the white data (Wb) is less than or equal to 1.

The subtraction part 234 generates 3-color output data (Rb, Gb, Bb) by subtracting the white data (Wb) from the 3-color amplification data (Ra, Ga, Ba) in accordance with the following equation:

$$Rb=Ra-Wb$$

$$Gb=Ga-Wb$$

$$Bb=Ba-Wb \quad \text{(Equation 7).}$$

Thus, the subtraction part 234 generates the 3-color output data (Rb, Gb, Bb) by subtracting the white data (Wb), which contribute to brightness of the red (R), green (G), and blue (B) pixels from the 3-color amplification data (Ra, Ga, Ba), so as to provide accurate display signals to the red (R), green (G), and blue (B) sub-pixels. The 3-color output data (Rb, Gb, Bb) from the subtraction part 234 and the white data (Wb) from the white data abstraction part 232 are provided to the gamma correction part 240.

As shown in FIG. 3, the gamma correction part 240 receives the 4-color output data (Rb, Gb, Bb, Wb) including the 3-color output data (Rb, Gb, Bb) and the white data (Wb) provided from the RGBW generation part 230 and generates the resulting 4-color output data (Ro, Go, Bo, Wo) by gamma-correcting the 4-color output data (Rb, Gb, Bb, Wb) according to the following equation:

$$Ro=(Rb)^{1/\lambda}$$

$$Go=(Gb)^{1/\lambda}$$

$$Bo=(Bb)^{1/\lambda}$$

$$Wo=(Wb)^{1/\lambda} \quad \text{(Equation 8).}$$

The gamma correction part 240 generates the resulting 4-color output data (Ro, Go, Bo, Wo) to be applied to a drive circuit of the liquid crystal panel 102 by gamma-correcting the 4-color output data (Rb, Gb, Bb, Wb) using a look-up table. The resulting 4-color output data (Ro, Go, Bo, Wo) is output to the timing controller 108.

In summary, the apparatus and method for driving an LCD device according to the exemplary embodiment of the present invention linearize the 3-color source data (RGB) by reverse gamma correcting the 3-color source data (RGB) inputted from an external source using the reverse gamma correction part 200 and generate the gain value (G) corresponding to the external 3-color source data (RGB) using the gain value generation part 210. Then, the apparatus and method generate the 3-color amplification data (Ra, Ga, Ba) by multiplying the 3-color source data (RGB) with the generated gain value (G) and abstract the white data (Wb) from the common component of the 3-color amplification data (Ra, Ga, Ba). Subsequently, the apparatus and method generate the 3-color output data (Rb, Gb, Bb) by subtracting the abstracted white data (Wb) from the 3-color amplification data (Ra, Ga, Ba). The resulting 4-color output data (Ro, Go, Bo, Wo) is generated by gamma-correcting the 3-color output data (Rb, Gb, Bb) and the white data (Wb). The resulting 4-color output data (Ro, Go, Bo, Wo) is then displayed on the liquid crystal panel 102.

Figure 7:
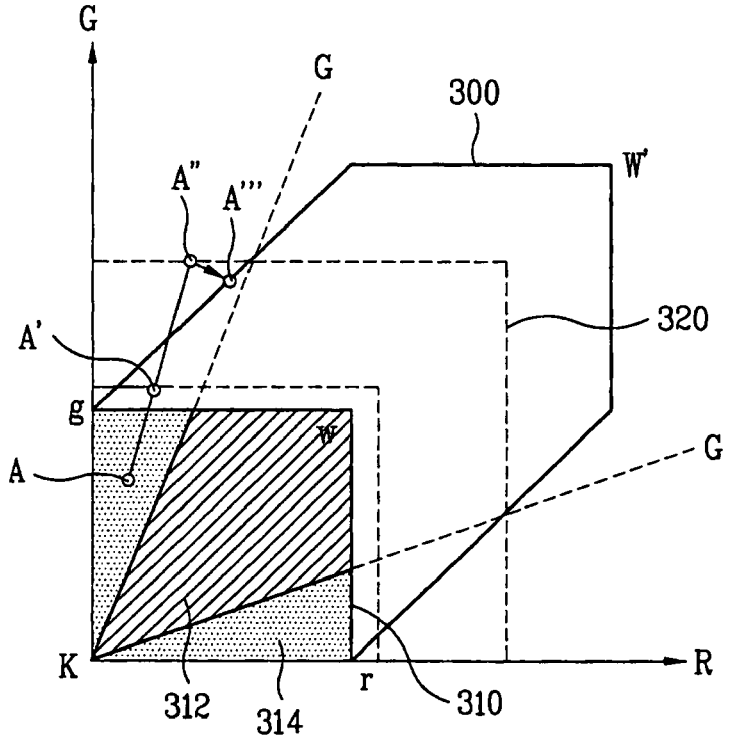
FIG. 7 is a graph illustrating color characteristics embodied in an apparatus for driving a liquid crystal display device and method using the same according to an exemplary embodiment of the present invention.

FIG. 7 is a graphical view illustrating color characteristics embodied in the apparatus and method according to the present invention. As shown in FIG. 7, color characteristics employed according to the present invention is represented as a polygonal area 300 defined by solid lines. A portion of the polygonal area, i.e., square area 310 (r, k, g, w), represents an area embodied by the red (R), green (G), and blue (B) sub-pixels, and a remaining area 320 is an area embodied by the white (W) sub-pixel. Since the polygonal area 300 represents the amount of amplified brightness, FIG. 7 shows that by setting the gain value (G) corresponding to the 3-color source data (RGB) and converting the 3-color source data (RGB) into the resulting 4-color output data (Ro, Go, Bo, Wo) according to the set gain value (G), the amount by which the brightness of the converted image can be increased is significantly improved.

For example, when the constant C value is set to 3 and the 3-color source data (RGB) is converted into the resulting 4-color output data (Ro, Go, Bo, Wo), an achromatic color signal area 312 hatched by oblique lines in the square area 310 (r, k, g, w) and a chromatic color signal area 314 hatched by dots result. More specifically, when a gain value (G) of the 3-color source data (RGB) corresponding to a brightness at point A in the chromatic signal area 314 is set to 1.1, the brightness of point A is amplified into a brightness of point A'. Since the brightness at point A' is within the polygonal area 300, the converted image is displayed without any problems. Thus, by setting the same brightness amplification factors with respect to the 3-color source data in a unit frame using a gain value (G), the above-described apparatus and method for driving an LCD device according to the present invention can naturally display various images in an RGBW type display device. Furthermore, since the apparatus and method according to the present invention can easily calculate the resulting 4-color output data (RGBW) from the 3-color source data (RGB) without additional division operations, it is possible to simplify the structure of the data conversion part 110.

The apparatus and method according to the exemplary embodiment of the present invention as described above can vary the gain value according to the 3-color source data (RGB). That is, when a percentage of the achromatic color signal is high in the total number of sub-pixels of the liquid crystal panel 102 in one frame, the gain value (G) in accordance with equation 4 is high. When an entire image is composed of an achromatic color signal, the gain value reaches its maximum. Conversely, when an entire image is composed of a chromatic color signal, since the gain value is 1, the 3-color source data is provided to the timing controller 108 without data conversion. However, since the RGBW display device has the color characteristic as shown in FIG. 7, when the gain value (G) is greater than 1, a part of the color components inevitably cannot be displayed.

Specifically, in the RGBW display device with the color characteristics as shown in FIG. 7, when the gain value (G) is set to '1.6' according to the 3-color source data (RGB), brightness at point A is amplified into brightness at point A", which is outside the remaining area 300. In this case, color of the corresponding sub-pixel cannot be properly displayed as a part of gray-scale information may get lost. However, since the present invention has a high gain value (G) when most of sub-pixel data in one frame are present in an achromatic signal area, sub-pixel data that deviate from the polygonal area 300 are few.

For the situations where the sub-pixel data deviate from the color area, the apparatus of the present invention may include a second exemplary embodiment of a data conversion part 110 to accurately display converted images even through the sub-pixel data deviate from the color characteristic area of the LCD device.

Figure 8:
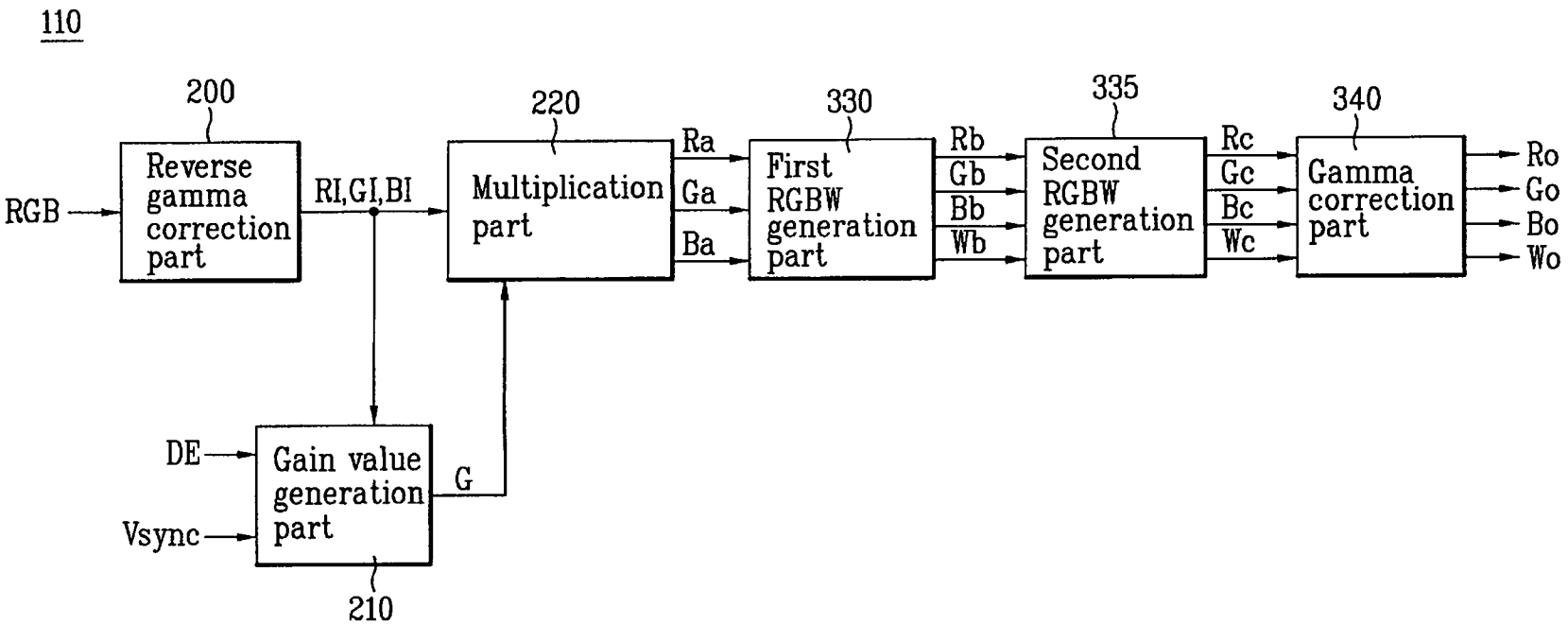
FIG. 8 is a block diagram illustrating a configuration of a second exemplary embodiment of the data conversion part of FIG. 2 according to the present invention.

FIG. 8 shows a block diagram illustrating a configuration of a second exemplary embodiment of the data conversion part 110 according to the present invention. As shown in FIG. 8, the data conversion part 110 according to the second exemplary embodiment of the present invention includes a reverse gamma correction part 200, a gain value generation part 210, a multiplication part 220, a first RGBW generation part 330, a second RGBW generation part 335, and a gamma correction part 340. Since the reverse gamma correction part 200, the gain value generation part 210, and the multiplication part 220 have the same structure as that of the first exemplary embodiment described previously, a detailed explanation of these elements is not repeated.

The first RGBW generation part 330 has the same structure and method of operation as that of the RGBW generation part 230 described previously with reference to FIG. 3. Accordingly, the first RGBW generation part 330 generates first output data (Rb, Gb, Bb, Wb) using the 3-color amplification data (Ra, Ga, Ba) from the multiplication part 220 and provides the first output data (Rb, Gb, Bb, Wb) to the second RGBW generation part 335. The second RGBW generation part 335 generates second output data (Rc, Gc, Bc, Wc) through additional operations, and provides the second output data (Rc, Gc, Bc, Wc) to the gamma-correction part 340 in order to more accurately display the converted image.

Figure 9:
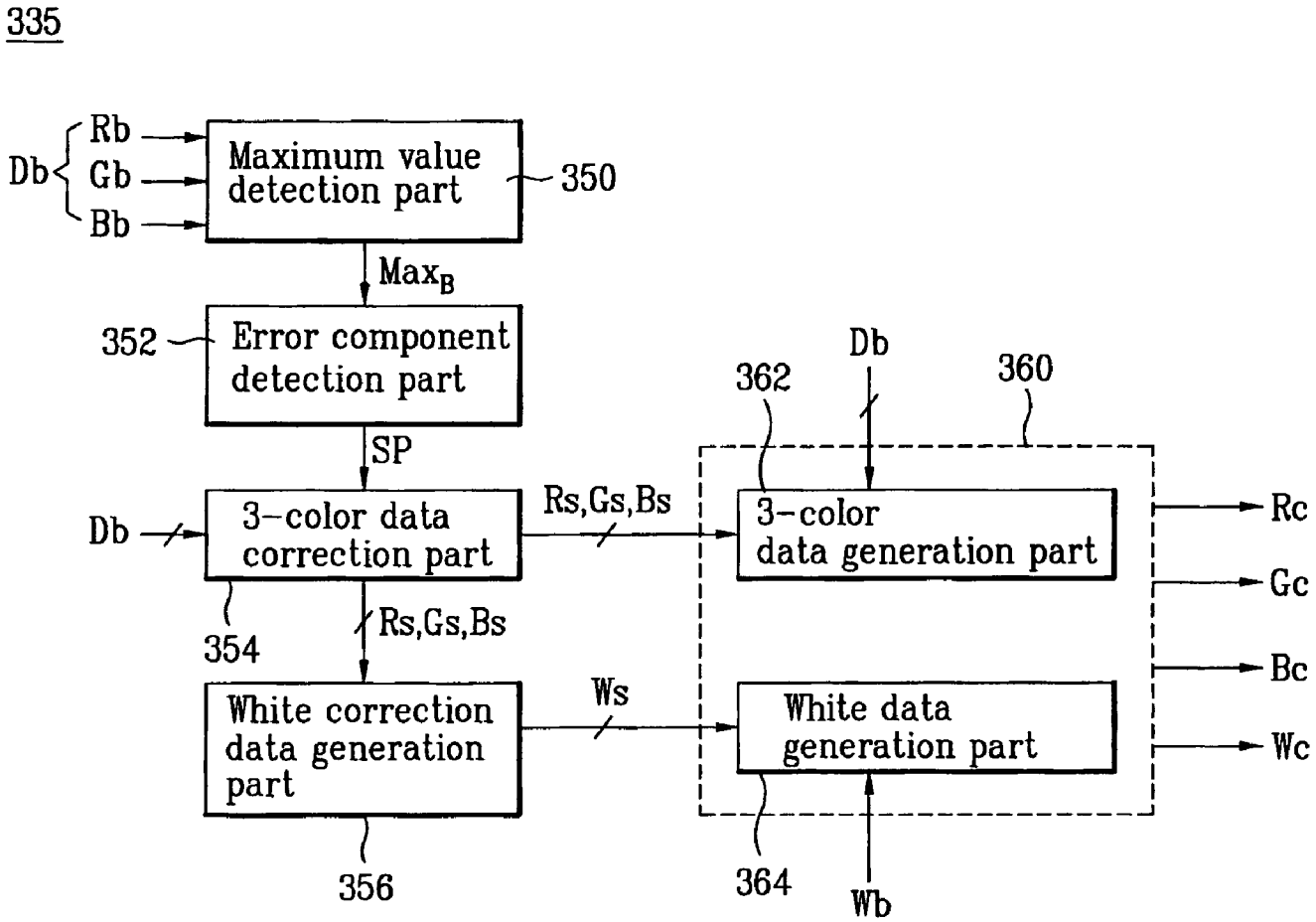
FIG. 9 is a block diagram illustrating a configuration of an exemplary embodiment of a second RGBW generation part of FIG. 8.

FIG. 9 shows a block diagram illustrating an exemplary embodiment of the second RGBW generation part of FIG. 8. As shown in FIG. 9, the second RGBW generation part 335 includes a maximum value detection part 350, an error component detection part 352, a 3-color data correction part 354, a white data correction part 356, and an output data generation part 360.

The maximum value detection part 350 detects a maximum value ($Max_B$) from the 3-color output data (Rb, Gb, Bb) among the 4-color output data (Rb, Gb, Bb, Wb) provided by the first RGBW generation part 335 and outputs the detected maximum value ($Max_B$). The maximum value ($Max_B$) is determined according to the following equation:

$$Max_B = Max(D_b) \quad \text{(Equation 9)},$$

where, Db is Rb, Gb, or Bb.

The error component detection part 352 detects an error component (SP) by subtracting 1 from the maximum value ($Max_B$) provided by the maximum value detection part 350 in accordance with the following equation:

$$SP = Max_B - 1 \quad \text{(Equation 10)},$$

where, $Max_B$ is greater than 1.

The 3-color data correction part 354 corrects the 3-color output data (Rb, Gb, Bb) using the error component (SP) and the maximum value ($Max_B$) in accordance with the following equation:

$$Rs = SP \times \left(\frac{Rb}{Max_B}\right) \quad \text{(Equation 11)}$$

$$Gs = SP \times \left(\frac{Gb}{Max_B}\right)$$

$$Bs = SP \times \left(\frac{Bb}{Max_B}\right).$$

Specifically, the 3-color data correction part 354 generates red correction data (Rs) by multiplying the error component (SP) with a resultant value acquired by dividing the red output data (Rb) by the maximum value ($Max_B$). Similarly, the 3-color data correction part 354 generates green and blue correction data (Gs, Bs) by multiplying the error component (SP) with a resultant value acquired by dividing the green and blue output data (Gb, Bb) by the maximum value ($Max_B$), respectively.

The white correction data generation part 356 generates white correction data (Ws) based on the 3-color correction data (Rs, Gs, Bs) provided by the 3-color data correction part 354 and outputs the white correction data (Ws). The white correction data (Ws) is generated based on the following equation:

$$Ws = xRs + yGs + zBs \quad \text{(Equation 12)},$$

where, x, y, and z are characteristic parameters for each red, green, and blue data, respectively, and may have the same value or different values.

More specifically, the white correction data generation part 356 generates the white correction data (Ws) by multiplying the 3-color correction data (Rs, Gs, Bs) with each characteristic parameter and then summing the multiplication result values together. The 3-color correction data (Rs, Gs, Bs) and the white correction data (Ws) are then inputted to the output data generation part 360.

The output data generation part 360 includes a 3-color data generation part 362 and a white data generation part 364. The 3-color data generation part 362 generates corrected 3-color output data (Rc, Gc, Bc) on the basis of the 3-color correction data (Rs, Gs, Bs) provided by the 3-color data correction part 354 and outputs the corrected 3-color output data (Rc, Gc, Bc) to the gamma correction part 340. The corrected 3-color output data (Rc, Gc, Bc) are generated based on the following equation:

$$Rc = Rb - Rs$$

$$Gc = Gb - Gs$$

$$Bc = Bb - Bs \quad \text{(Equation 13)}.$$

Particularly, the 3-color data generation part 362 generates corrected red output data (Rc) by subtracting the red correction data (Rs) from the red output data (Rb). Similary, the 3-color data generation part 362 generates corrected green and blue output data (Gc, Bc) by subtracting the green and blue correction data (Gs, Bs) from the green and blue output data (Gb, Bb), respectively.

The white data generation part 364 generates corrected white output data (Wc) by adding the white output data (Wb) to the white correction data (Ws) provided by the white correction data generation part 356 and outputs the corrected white output data (Wc) to the gamma correction part 340. The corrected white output data (Wc) is generated in accordance with the following equation:

$$Wc=Wb+Ws \quad \text{(Equation 14).}$$

The gamma correction part 340 receives the corrected output data (Rc, Gc, Bc, Wc) including the corrected 3-color output data (Rc, Gc, Bc) and the corrected white output data (Wc) provided by the output data generation part 360 and gamma-corrects the corrected output data (Rc, Gc, Bc, Wc) according to the following equation:

$$Ro=(Rc)^{1/\lambda}$$

$$Go=(Gc)^{1/\lambda}$$

$$Bo=(Bc)^{1/\lambda}$$

$$Wo=(Wc)^{1/\lambda} \quad \text{(Equation 15).}$$

The gamma correction part 340 then converts the gamma-corrected 3-color output data (Rc, Gc, Bc, Wc) into the resulting 4-color output data (Ro, Go, Bo, Wo). The gamma correction part 340 generates the resulting 4-color output data (Ro, Go, Bo, Wo) to be applied to the drive circuit of the liquid crystal panel 102 by gamma-correcting the corrected 3-color output data (Rc, Gc, Bc, Wc) using a look-up table and outputs the resulting 4-color output data (Ro, Go, Bo, Wo) to the timing controller 108. Thus, when the converted RGBW brightness deviates from a defined area, such as point A" shown in FIG. 7, the second exemplary embodiment of the data conversion part 110 according to the present invention is able to amplify the brightness to display images more accurately by correcting the brightness at point A" into the brightness at point A'" in accordance with the operations described above using equations 9 to 15.

While the gain value generation part 210 generates a linearized gain value using equation 4 in the above-described exemplary embodiment of the present invention, the gain value generation part 210 may alternatively be set a non-linearized gain value using an exponential function k:

$$G = 1 + \alpha\left(\frac{Cb}{Tpixel}\right)^{k}. \quad \text{(Equation 16)}$$

It will be apparent to those skilled in the art that various modifications and variations can be made in the apparatus for driving an LCD device of the present invention and driving method using the same without departing form the spirit or scope of the invention. Thus, it is intended that the present invention cover the modifications and variations of this invention provided they come within the scope of the appended claims and their equivalents.

What is claimed is:

1. An apparatus for driving a liquid crystal display (LCD) device, comprising:

a liquid crystal panel including 4-color sub-pixels;

a data driver to provide video data signals to each sub-pixel;

a gate driver to provide a scan pulse to each sub-pixel;

a data conversion part to generate a gain value by analyzing a ratio of an achromatic color signal or a chromatic color signal of 3-color source data inputted from an external source in a unit frame and convert the 3-color source data into 4-color data using the generated gain value, wherein the data conversion detects a maximum brightness value and a minimum brightness value of the 3-color source data and analyzis the ratio of the achromatic color signal or the chromatic color signal in the unit frame using the detected maximum and minimum brightness values; and a timing controller to provide the 4-color data received from the data conversion part to the data driver and control the gate driver and the data driver, wherein a data conversion part includes the gain value generation part including:

a brightness detection part to detect the maximum brightness value and the minimum brightness value of the 3-color input data and output the detected maximum brightness value and a calculated maximum brightness value acquired by multiplying the minimum brightness value by a C value (C value being a positive real number);

a comparator to compare the calculated maximum brightness value with the detected maximum brightness value and output a comparison result signal;

a counter to count the comparison result signal in a unit frame and generate a count signal; and a gain value setting part to set the gain value according to the count signal.

2. The apparatus as set forth in claim 1, wherein the data conversion part further includes:

a reverse gamma correction part to reverse gamma correct the 3-color source data to generate 3-color input data;

a multiplication part to multiply the 3-color input data by the gain value to generate 3-color amplification data;

a first 4-color data generation part to abstract first white data from a common component of the 3-color amplification data, generate first 3-color output data using the first white data, and output the first 3-color output data and the first white data; and a gamma correction part to gamma correct the first white data and the first 3-color output data to generate the 4-color data.

3. The apparatus as set forth in claim 2, wherein the comparator outputs the comparison signal with a first logical value corresponding to the achromatic color signal when the calculated maximum brightness value is greater than or equal to the detected maximum brightness value, and the comparator outputs the comparison signal with a second logical value corresponding to the chromatic color signal when the calculated maximum brightness value is less than the detected maximum brightness value.

4. The apparatus as set forth in claim 2, wherein the gain value setting part sets the gain value to a number between 1 and 1+α (α value being a positive real number) according to the count signal.

5. The apparatus as set forth in claim 4, wherein the gain value setting part divides the count signal by a predetermined number of pixels of the liquid crystal panel to produce the α value and sets the gain value by adding a constant of 1 to the α value.

6. The apparatus as set forth in claim 2, wherein the first 4-color data generation part generates the first 3-color output data by subtracting the abstracted first white data from the 3-color amplification data.

7. The apparatus as set forth in claim 6, wherein the first 4-color data generation part removes the abstracted first white data from the 3-color amplification data by a 3-color α value representing a relative size that the abstracted first white data respectively contributes to a brightness of the first 3-color output data.

8. The apparatus as set forth in claim 1, wherein the data conversion part further includes:

a reverse gamma correction part to reverse gamma correct the 3-color source data to generate 3-color input data;

a multiplication part to multiply the 3-color input data by the gain value to generate 3-color amplification data;

a first 4-color data generation part to abstract first white data from a common component of the 3-color amplification data, generate first 3-color output data using the first white data, and output the first 3-color output data and the first white data;

a second 4-color data generation part to correct the first white data and the first 3-color output data, and generate second white data and second 3-color output data; and a gamma correction part to gamma correct the second white data and the second 3-color output data to generate the 4-color data.

9. The apparatus as set forth in claim 8, wherein the comparator outputs the comparison signal with a first logical value corresponding to the achromatic color signal when the calculated maximum brightness value is greater than or equal to the detected maximum brightness value, and the comparator outputs the comparison signal with a second logical value corresponding to the chromatic color signal when the calculated maximum brightness value is less than the detected maximum brightness value.

10. The apparatus as set forth in claim 8, wherein the gain value setting part sets the gain value to a number between 1 and 1+α (a value being a positive real number) according to the count signal.

11. The apparatus as set forth in claim 10, wherein the gain value setting part divides the count signal by a predetermined number of pixels of the liquid crystal panel to produce the α value and sets the gain value by adding a constant of 1 to the α value.

12. The apparatus as set forth in claim 8, wherein the first 4-color data generation part generates the first 3-color output data by subtracting the abstracted first white data from the 3-color amplification data.

13. The apparatus as set forth in claim 12, wherein the first 4-color data generation part removes the abstracted first white data from the 3-color amplification data by a 3-color α value representing a relative size that the abstracted first white data respectively contributes to a brightness of the first 3-color output data.

14. The apparatus as set forth in claim 8, wherein the second 4-color data generation part includes:

a maximum value detection part to detect a maximum brightness value of the first 3-color output data;

an error component detection part to detect an error component using the maximum brightness value;

a 3-color data correction part to generate 3-color correction data using the first 3-color output data and the error component;

a white correction data generation part to generate white correction data using the 3-color correction data;

a 3-color data generation part to generate the second 3-color output data using the first 3-color output data and the 3-color correction data; and a white data generation part to generate the second white data using the white correction data and the first white data.

15. The apparatus as set forth in claim 14, wherein the error component detection part subtracts a constant of 1 from the maximum brightness value.

16. The apparatus as set forth in claim 14, wherein the 3-color data correction part generates the 3-color correction data by multiplying the error component with a resultant value obtained by dividing the first 3-color output data by the maximum brightness value.

17. The apparatus as set forth in claim 14, wherein the white correction data generation part multiplies each characteristic parameter of the 3-color source data with the 3-color correction data and generates the white correction data by summing together each multiplication result value.

18. The apparatus as set forth in claim 14, wherein the 3-color data generation part generates the second 3-color output data by subtracting the 3-color correction data from the first 3-color output data.

19. The apparatus as set forth in claim 14, wherein the white data generation part generates the second white data by adding the white correction data to the first white data.

20. A method for controlling a liquid crystal display (LCD) device which includes a liquid crystal panel including 4-color sub-pixels, a data driver for providing video data signals to each sub-pixel, and a gate driver for providing a scan pulse to the sub-pixels, comprising:

detecting a maximum brightness value and a minimum brightness value of the 3-color source data inputted from an external source;

generating a gain value by analyzing a ratio of an achromatic color signal or a chromatic color signal of the 3-color source data in a unit frame using the detected maximum and minimum brightness values;

converting the 3-color source data into 4-color video data using the generated gain value;

generating the scan pulse; and applying the 4-color video data to each sub-pixel in synchronization with the scan pulse, wherein the step of generating the gain value includes:

generating a calculated maximum brightness value by multiplying the minimum brightness value with a C value (C value being a positive real number);

comparing the calculated maximum brightness value with the detected maximum brightness value and generating a comparison result signal;

counting the comparison result signal in a unit frame and generating a count signal; and setting the gain value according to the count signal.

21. The method as set forth in claim 20, wherein the step of generating the gain value further includes:

reverse gamma correcting the 3-color source data to generate 3-color input data prior to detecting the maximum and minimum brightness values.

22. The method as set forth in claim 21, wherein the step of generating the comparison result signal includes outputting a first logical value corresponding to the achromatic color signal when the calculated maximum brightness value is greater than or equal to the detected maximum brightness value or a second logical value corresponding to the chromatic color signal when the calculated maximum brightness value is less than the detected maximum brightness value.

23. The method as set forth in claim 21, wherein the gain value is set to a number between 1 and 1+α (α value being a positive real number) according to the count signal.

24. The method as set forth in claim 23, wherein the step of setting the gain value includes:

dividing the count signal by a predetermined number of pixels of the liquid crystal panel to producing the α value; and setting the gain value by adding a constant of 1 to the α value.

25. The method as set forth in claim 20, wherein the step of converting the 3-color source data into the 4-color video data includes:

multiplying the 3-color input data by the gain value to generate 3-color amplification data;

abstracting first white data from a common component of the 3-color amplification data;

generating first 3-color output data using the first white data; and gamma-correcting the first white data and the first 3-color output data to generate the 4-color video data.

26. The method as set forth in claim 25, wherein the step of generating the first 3-color output data includes subtracting the abstracted first white data from the 3-color amplification data.

27. The method as set forth in claim 26, wherein the step of subtracting the first white data includes removing the abstracted first white data from the 3-color amplification data by a 3-color α value representing a relative size that the abstracted first white data respectively contributes to a brightness of the first 3-color output data.

28. The method as set forth in claim 20, wherein the step of converting the 3-color source data into the 4-color video data include:

multiplying the 3-color input data by the gain value to generate 3-color amplification data;

abstracting first white data from a common component of the 3-color amplification data;

generating first 3-color output data using the first white data;

generating second white data and second 3-color output data using the first white data and the first 3-color output data; and gamma-correcting the second white data and the second 3-color output data to generate the 4-color video data.

29. The method as set forth in claim 28, wherein the step of generating the first 3-color output data includes subtracting the abstracted first white data from the 3-color amplification data.

30. The method as set forth in claim 29, wherein the step of subtracting the first white data includes removing the abstracted first white data from the 3-color amplification data by a 3-color α value representing a relative size that the abstracted first white data respectively contributes to a brightness of the first 3-color output data.

31. The method as set forth in claim 28, wherein the step of generating the second white data and the second 3-color output data includes:

detecting a maximum brightness value of the first 3-color output data;

detecting an error component using the maximum brightness value;

generating 3-color correction data using the first 3-color output data and the error component;

generating white correction data using the 3-color correction data;

generating the second 3-color output data using the first 3-color output data and the 3-color correction data; and generating the second white data using the white correction data and the first white data.

32. The method as set forth in claim 31, wherein the step of detecting the error component includes subtracting a constant of 1 from the maximum brightness value.

33. The method as set forth in claim 31, wherein the step of generating the 3-color correction data includes:

dividing the first 3-color output data by the maximum brightness value; and generating the 3-color correction data by multiplying the error component with a division result value.

34. The method as set forth in claim 31, wherein the step of generating the white correction data includes:

multiplying each characteristic parameter of the 3-color source data by the 3-color correction data; and generating the white correction data by summing together the multiplication result values.

35. The method as set forth in claim 31, wherein the second 3-color output data is generated by subtracting the 3-color correction data from the first 3-color output data.

36. The method as set forth in claim 31, wherein the second white data is generated by adding the white correction data to the first white data.

* * * * *